US007076928B2

(12) United States Patent
Kliegle et al.

(10) Patent No.: US 7,076,928 B2
(45) Date of Patent: Jul. 18, 2006

(54) SUSPENDED CEILING PANEL EDGE AND RIB TECHNOLOGY

(75) Inventors: Dennis Robert Kliegle, Holcombe, WI (US); Doyle R. Quiggle, Tomahawk, WI (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 366 days.

(21) Appl. No.: 10/067,161

(22) Filed: Feb. 4, 2002

(65) Prior Publication Data

US 2003/0145547 A1 Aug. 7, 2003

(51) Int. Cl.
*E04B 9/00* (2006.01)

(52) U.S. Cl. ..... 52/506.09; 52/506.07; 428/192

(58) Field of Classification Search ..... 52/506.05, 52/506.07, 506.08, 506.06, 506.09, 406.1, 52/489.1, 509, 22, 578, 582.1
See application file for complete search history.

(56) References Cited

U.S. PATENT DOCUMENTS

| | | | | |
|---|---|---|---|---|
| 2,071,865 A | | 2/1937 | Parsons | |
| 2,231,780 A | * | 2/1941 | Swenson | 52/390 |
| 2,822,584 A | * | 2/1958 | Urbain | 52/506.09 |
| 2,877,878 A | * | 3/1959 | Jantsch | 52/506.09 |
| 2,993,240 A | | 7/1961 | Ericson | |
| 3,032,833 A | * | 5/1962 | Stanley | 52/506.07 |
| 3,055,466 A | * | 9/1962 | Brown | 52/733.1 |
| 3,276,179 A | * | 10/1966 | Rallis | 52/506.09 |
| 3,303,624 A | | 2/1967 | Swain | |
| 3,381,437 A | * | 5/1968 | Kidney | 52/779 |
| 3,640,042 A | * | 2/1972 | Kidney | 52/506.09 |
| 3,736,901 A | * | 6/1973 | Aspenson | 118/710 |
| 3,828,508 A | | 8/1974 | Moeller | |
| 3,863,413 A | | 2/1975 | Moomey | |
| 3,919,444 A | * | 11/1975 | Shayman | 428/95 |
| 3,955,031 A | | 5/1976 | Jones et al. | |
| 4,062,164 A | | 12/1977 | Cousins | |
| 4,158,713 A | | 6/1979 | Degens | |
| 4,169,340 A | * | 10/1979 | Watson | 52/774 |
| 4,764,420 A | | 8/1988 | Gluck et al. | |
| 4,875,320 A | * | 10/1989 | Sparkes | 52/406.1 |
| 4,927,705 A | | 5/1990 | Syme et al. | |
| 4,952,441 A | | 8/1990 | Bose et al. | |
| 5,030,518 A | | 7/1991 | Keller | |
| 5,051,144 A | | 9/1991 | Kistner | |

(Continued)

FOREIGN PATENT DOCUMENTS

DE 2721541 A1 11/1978

(Continued)

*Primary Examiner*—Robert Canfield
(74) *Attorney, Agent, or Firm*—Inger H. Eckert; Maria C. Gasaway

(57) ABSTRACT

Panels for a suspended ceiling of the torsional spring type are disclosed. Such panels can include: a circumferential edge configuration that preserves a very tight tolerance between a surface bearing against a foot portion of a T-bar and a face of the panel; and/or reinforcing ribs in the form of T-bars whose foot portions are inserted between the laminae of a typical ceiling panel. Each circumferential side edge configuration is multifaceted and includes: a first surface intersecting the back surface; a second surface intersecting the first surface and substantially parallel to the face surface; a third surface intersecting the second surface and substantially orthogonal to the face surface; and a fourth surface intersecting, and being beveled relative to, the third surface. The length of the first surface will vary in close proportion to the variations in the thickness of a new panel, which makes the machined back-to-face distance very uniform.

14 Claims, 13 Drawing Sheets

U.S. PATENT DOCUMENTS

| | | | | | |
|---|---|---|---|---|---|
| 5,261,204 | A | * | 11/1993 | Neff | 52/506.06 |
| 5,277,955 | A | | 1/1994 | Schelhorn et al. | |
| 5,329,739 | A | | 7/1994 | Madl, Jr. | |
| 5,355,648 | A | | 10/1994 | Graver et al. | |
| 5,362,539 | A | | 11/1994 | Hall et al. | |
| 5,466,317 | A | | 11/1995 | Lause et al. | |
| 5,624,726 | A | | 4/1997 | Sanocki et al. | |
| 5,732,521 | A | * | 3/1998 | Schmitt-Raiser | 52/506.07 |
| 5,765,334 | A | * | 6/1998 | Vitous | 52/745.19 |
| 5,871,830 | A | | 2/1999 | Miller | |
| 5,893,248 | A | | 4/1999 | Beliveau | |
| 6,228,497 | B1 | * | 5/2001 | Dombeck | 428/392 |
| 6,230,463 | B1 | * | 5/2001 | Bodine | 52/506.07 |
| 6,523,314 | B1 | * | 2/2003 | LaLonde et al. | 52/506.07 |

FOREIGN PATENT DOCUMENTS

| | | |
|---|---|---|
| FR | 1213772 | 4/1960 |
| GB | 860699 | 2/1961 |
| JP | 5065761 | 3/1933 |

* cited by examiner

SUSPENDED CEILING PANEL EDGE AND RIB TECHNOLOGY

FIELD OF THE INVENTION

The invention is directed toward the field of suspended ceiling systems, more particularly to torsion spring attachment systems, more particularly edge and rib technology for panels in such systems.

BACKGROUND OF THE INVENTION

FIG. 1 depicts a typical suspended ceiling system of the torsion spring type according to the Background art. System 1 includes a plurality of ceiling panels 2 that are supported by a grid 4. Torsion springs 12 hold each panel 2 against a foot portion 4*a* of the grid 4. One of the panels 2, namely panel 2*a*, is depicted as being in the open or partially disconnected position. Two of the torsion springs 12, namely torsion springs 12*a*, are shown in the disengaged position relative to butterfly clips 6. The other two torsion springs 12 of panel 2*a* are disconnected from their corresponding butterfly clips (not shown).

The dangling ceiling panel 2*a* shows that each panel 2 has a metal frame 8 around its circumferential edge. Clips 10 permit the frame 8 to be connected to a torsional spring 12.

FIG. 2 shows the relationships between the support grid 4 and the ceiling panels 2 in more detail. In FIG. 2, the support grid is formed of known T-bars 250. Each T-bar 250 has a foot flange 253, a web 251 and a bead portion 254. Attached to the bead 254 is a butterfly clip 230 via a releasable fastener, e.g., a screw 240. Each butterfly clip 230 includes a U-shaped channel 232 and a projecting flange 234 into which is formed a slot 236. Arms 218 of the torsional spring 214 fit into ends of the slot 236. The torsional spring 214 is shown in the disengaged position wherein retaining feet 220 of the torsional spring 214 rest against an upper surface of the projecting flange 234.

A framed panel 20 has a frame 26 formed around the circumferential edge of the panel 28. The framed panel 20 can have an optional fabric cover 210. An attachment clip 212 fits over a flange of the frame 2*b*. A hook portion of an attachment clip 212 fits into the wound portion 216 of the torsional spring 214.

To fit the framed panel 20 against the T-bars 250, the arms 218 of the torsion spring 14 are pushed up through the slot 236 resulting in the arms 218 spreading out in a v-shape. Consequently, the frame 26 (or the fabric 210) will bear against the foot portion 253 of the T-bar. To assist in aligning adjacent panels, an optional alignment clip 290 can be attached to the T-bar 250.

Panels are typically two feet by two feet. But, some systems feature larger panels, e.g., four feet by eight feet (a standard size in the construction industry). Such a large-panel system is depicted in FIGS. 3. Each of the panels 32 in the system 30 is substantially planar. Unfortunately, one of the panels, namely panel 34, has begun to sag. This can create a very negative impression for a viewer, e.g., as if the system is of poor quality and/or the building is poorly maintained.

Also, panels 32 typically have a nominal (N) thickness plus a tolerance (T), effectively resulting in a size range from a minimum size (Min), where Min=N−T, to a maximum size (Max), where Max=N+T. Where the tolerance is not very small, the effect is to produce a grid system 1 that does not give the impression of forming a planar surface as the ceiling.

The non-planar surface problem is illustrated more particularly in FIG. 4, where such a system 40 with significant panel tolerances is depicted. For the purposes of illustration, the system 40 is very simplified. Panels 46A represent nominal thickness panels. Panel 46B represents a minimum thickness panel. And panel 46C represents a maximum thickness panel. Back surfaces 48 of each panel bear against foot portions 44 of T-bars 42 via force of torsion spring arrangements (not shown, again for simplicity). The varying thicknesses of the panels 46A, 46B and 46C result in the faces 49*a*, 49*b* and 49*c*, respectively, being different distances from the foot portions 44. And that gives the viewer of such a system 40 the impression that the ceiling is non-planar.

SUMMARY OF THE INVENTION

The invention is, in part, recognition that raw ceiling panels with significant manufacturing tolerances can subsequently be machined to produce a circumferential edge configuration that preserves a very tight tolerance between a surface bearing against a foot portion of a T-bar and a face of the panel.

The invention is, also in part, a recognition that reinforcing ribs can be easily added post-manufacture (i.e., after manufacture of the new fiberglass panel, but before finishing steps such as edge hardening and/or fabric wrapping) to a typical ceiling panel by inserting the foot portion of a T-bar between the laminae of a typical ceiling panel.

The invention, also in part, provides a surface panel (and a method for the making of it) with such a circumferential edge configuration, the panel having a major dimension, a minor dimension and a thickness dimension, a side edge of said panel corresponding to said thickness dimension, a face surface of said panel facing toward a room and being substantially coplanar with a plane defined by said major and minor dimensions, a back surface of said panel being opposite of said face surface. Each side edge of such a panel is multifaceted and includes: a first surface intersecting said back surface; a second surface intersecting said first surface and substantially parallel to said face surface; a third surface intersecting said second surface and substantially orthogonal to said face surface; and a fourth surface intersecting, and being beveled relative to, said third surface. The invention, also in part, provides a surface paneling system including a plurality of such surface panels.

The invention also provides, in part, a reinforced surface panel (and a method for the making of such) having a major dimension, a minor dimension and a thickness dimension corresponding to side edges, said panel being laminated wherein the laminae are substantially coplanar with a plane defined by said major and minor dimensions. Such a panel has: a groove, oriented substantially in said thickness direction, leading from a side edge and extending across said central portion; and at least one reinforcement rib inserted between two of said laminae such that at least a part of said rib is substantially coplanar with said laminae, said rib extending across a central portion relative to one of said major and minor dimensions; wherein said reinforcement rib is a T-bar that, in cross-section, has a T shape, a web of said T-bar being located in said groove, a foot part of said T-bar corresponding to the part of said T-bar that is substantially coplanar with said laminae.

A ceiling panel according to the invention can feature the circumferential edge configuration and/or the reinforcement rib.

Additional features and advantages of the invention will be more fully apparent from the following detailed description of the preferred embodiments, the appended claims and the accompanying drawings.

BRIEF DESCRIPTION OF THE DRAWINGS

The accompanying drawings are: intended to depict example embodiments of the invention and should not be interpreted to limit the scope thereof; and not to be considered as drawn to scale unless explicitly noted.

DETAILED DESCRIPTION OF PREFERRED EMBODIMENTS

A first embodiment of the invention is directed toward a suspended ceiling of the torsion spring type that achieves a planar ceiling surface despite using panels of non-uniform thickness.

A second embodiment of the invention is directed toward a reinforced ceiling panel, e.g., for use in a suspended ceiling system of the torsions spring type, that is suitable for large panel applications.

Figure 1:
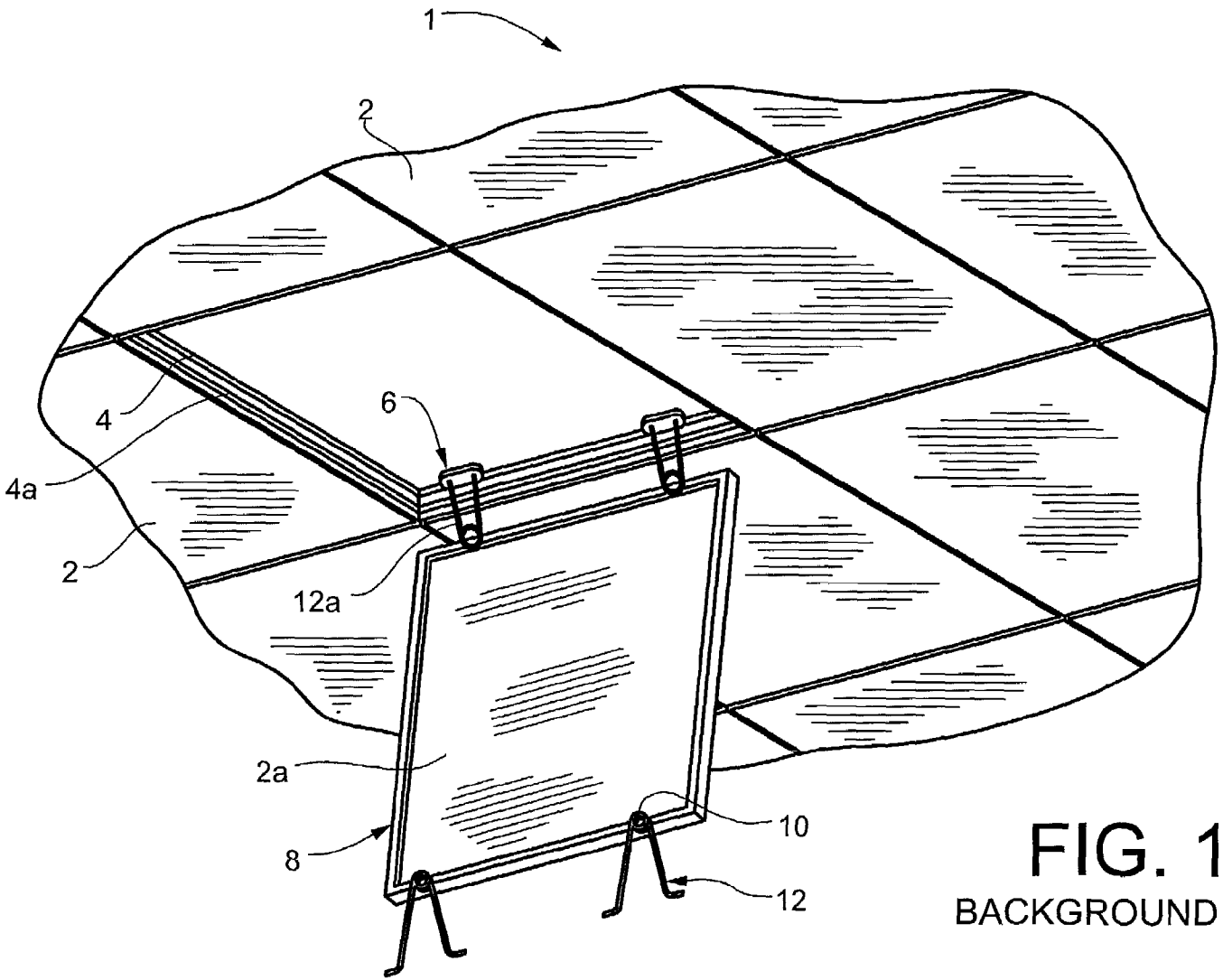
FIG. 1 BACKGROUND ART
FIG. 1 is a three-quarter perspective drawing of a suspended ceiling system of the torsion spring type according to the Background Art.
Figure 2:
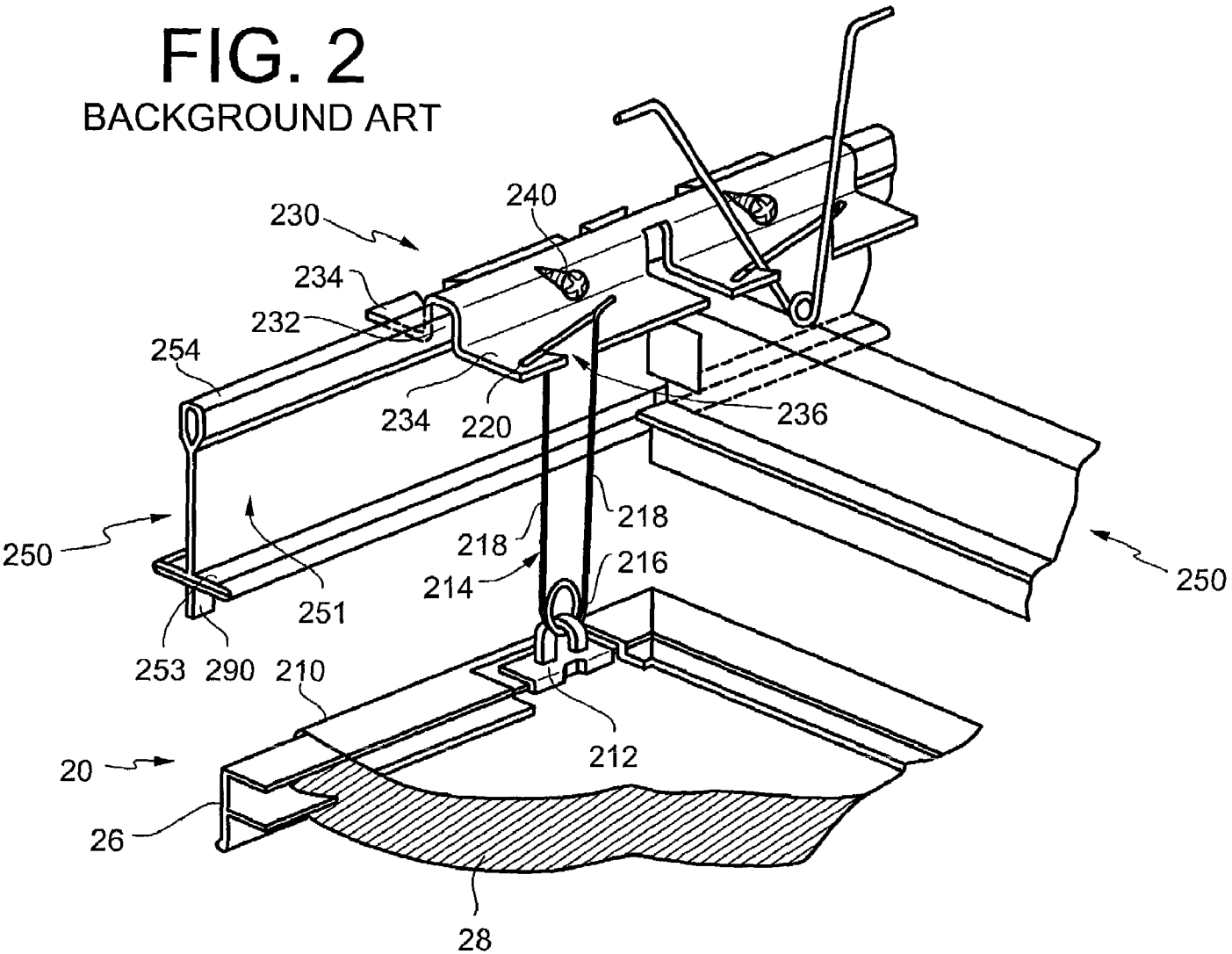
FIG. 2 BACKGROUND ART
FIG. 2 is a more detailed view of the torsion spring arrangement according to the Background Art.
Figure 3:
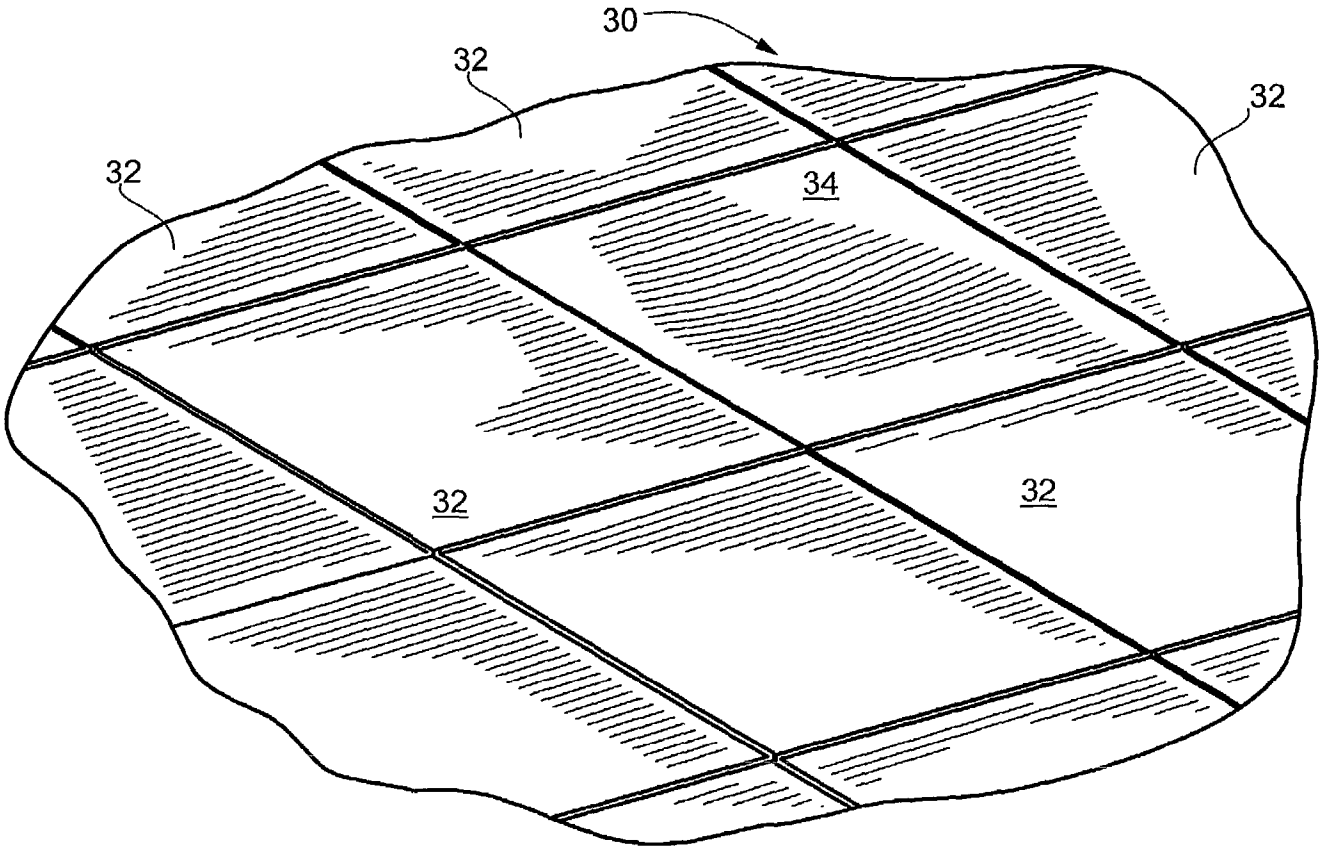
FIG. 3 BACKGROUND ART
FIG. 3 is a three-quarter perspective of a suspended ceiling of the torsion type according to the Background Art suffering a sagging panel.
Figure 4:
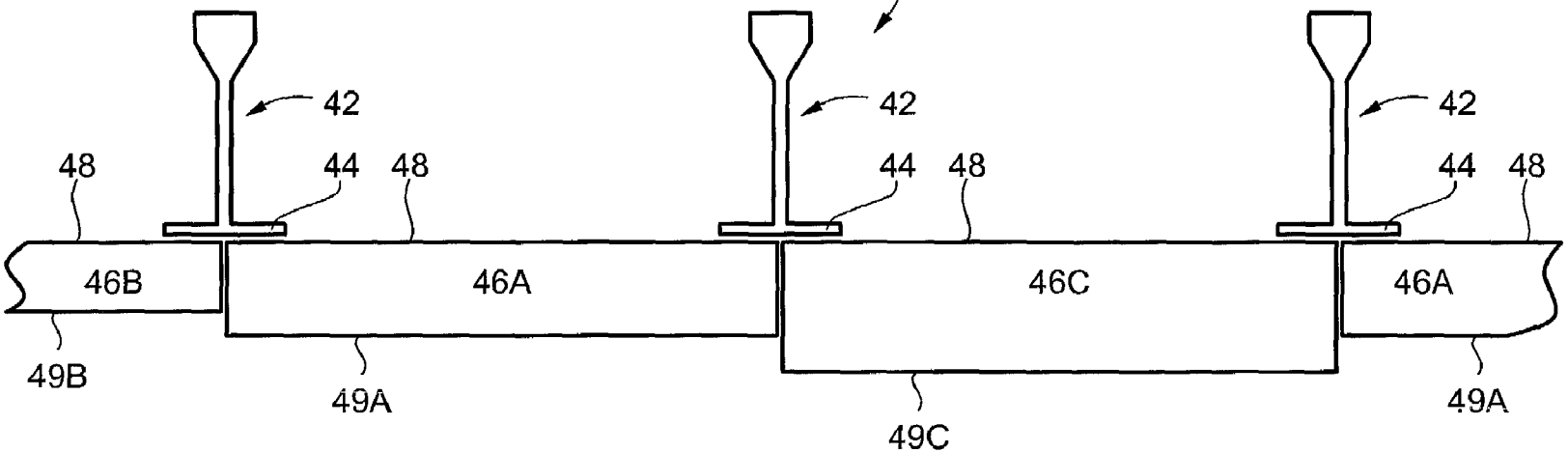
FIG. 4 BACKGROUND ART
FIG. 4 is a cross-sectional view of a suspending ceiling of the torsion type according to the Background Art that exhibits a non-planar ceiling surface.
Figure 5:
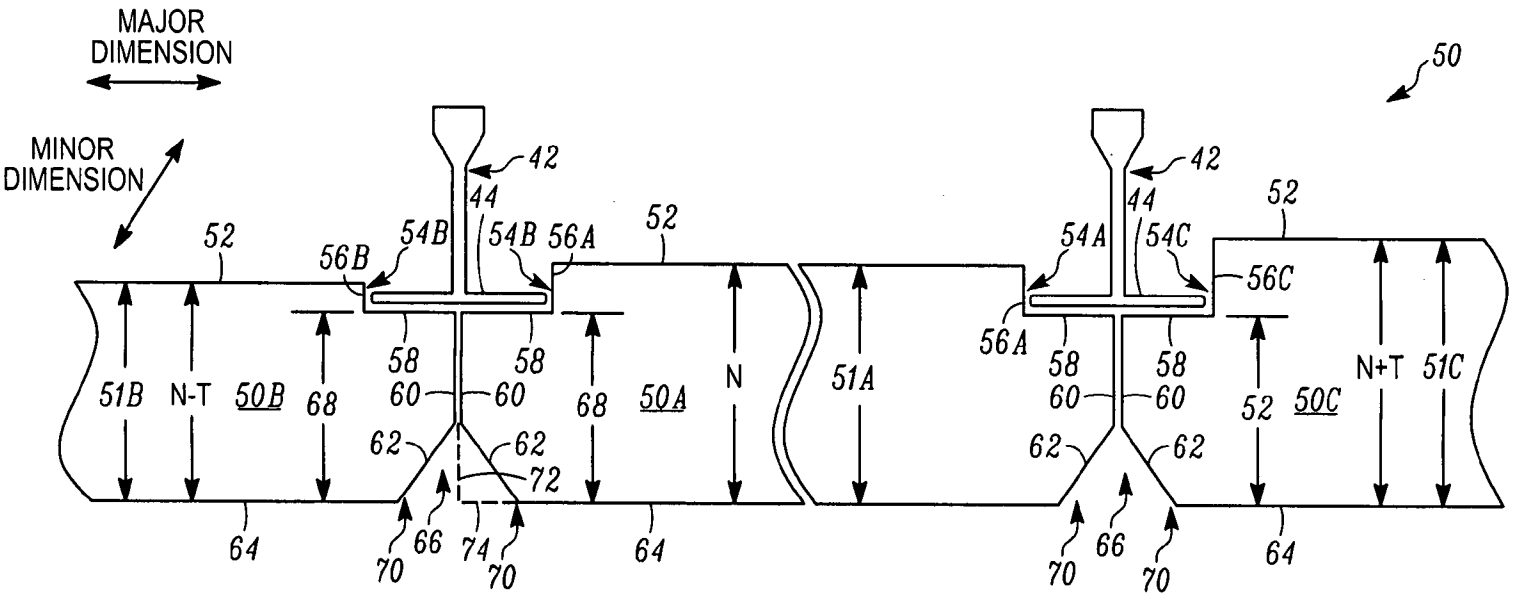
FIG. 5 is a cross-sectional view of an embodiment of the invention showing a planar ceiling surface despite using ceiling panels of varying thickness.

FIG. 5 relates to the first embodiment. It is a cross-sectional view of an embodiment of the invention showing a planar ceiling surface despite ceiling panels of varying thickness.

The suspended ceiling system 50 of FIG. 5 is of the torsion spring type. A support grid from which the panels 50A, 50B and 50C hang is formed, in part, of known T-bars 42, each of which have a foot portion 44. For simplicity, the torsional spring arrangement is not depicted in FIG. 5. Each panel 50 is a rectangular solid having a back surface 52, a face 64 and a circumferential side edge.

Each panel 50 is also made of a material that can be milled. Examples of such panels are those available from the CONWED DESIGNSCAPE Co. as part of the RESPOND ACCESS CEILING brand of suspended ceiling.

In FIG. 5, panels 50A, 50B and 50C have different thicknesses 51A, 51B and 51C, respectively. Most commercially viable ceiling panels will have a significant manufacturing tolerance, i.e., a nominal thickness (N) plus or minus a tolerance amount (T). Panel 50A corresponds to a panel of nominal thickness (N). Panel 50B represents a panel of minimum thickness (Min), i.e., Min=N−T. And panel 50C represents a panel of maximum thickness (Max), i.e., Max=N+T.

In part, the first embodiment of the invention is recognition that the visual impression of a planar ceiling surface can be achieved if a face-to-foot distance 68 can be tightly controlled so as to have a nominal value with a small tolerance. If that can be achieved, then significant variation in the raw thickness 51A, 51B and 51C can be tolerated while still achieving the visual impression of a planar surface.

A back cut 54A, 54B and 54C is made in the upper portion of the circumferential side edge of each of the panels 50A, 50B and 50C, respectively. Each back cut produces first surfaces 56A, 56B and 56C, respectively, which intersect and are substantially perpendicular to the back surface 52. The back cut also produces second surfaces 58 that intersect the first surfaces 56*a*, 56*b* and 56*c*, respectively, and which are substantially parallel to the back surfaces 52. Each circumferential edge has a third surface 60 that intersects the second surface 58 and which is substantially perpendicular to the second surface 58 and the back surface 52. The third surface 60 can be a remaining portion of the original circumferential edge of the raw panel or can be a newly machined surface.

Each panel 50 further includes a fourth surface 62 that intersects, and is beveled relative to, the third surface 60. In addition, the fourth or beveled surface 62 intersects the face surface 64 of each panel 50.

When each panel is fitted against the foot portion 44 of the T-bar 42, the foot portion 44 nestles into the back cut (or recess) 54. The length of each surface 58 is approximately one-half of the length of the foot portion 44 so that two abutting panels 50 together (at the third surfaces 60) form a recess sufficient to receive the foot portion 44.

The length of each first surface 54 will be determined by the difference between the raw thickness 51 of the panel 50 minus the machined distance 68, e.g., length(54A)=length (51A)−distance(68). In practice, it is expected that the length of the first surface 54 will not be calculated. Rather, as the circumferential edge configuration of each panel 50 is shaped to produce the four surfaces 56, 58, 60 and 62 so as to achieve the machined distance 68, the length of surface 56 will be determined as a by-product. It is also noted that the length of the first surface 54 will vary in close proportion to variations in the raw thickness 51.

When two panels 50 abut as depicted in FIG. 5, the abutting surfaces 60 and 62 form a reveal 66. To the extent that there is any difference in the machine heights 68, the reveal 66 helps diminish a viewer's impression of a non-planar surface because the reveal separates the corners 70 so as to lessen the perception of mismatched heights.

Example dimensions for the machined circumferential edge follow. A value for the machined distance 68 can be 15/16 inch, where the length of first surface 54 can nominally be 1/16 inch. A length of the third surface 60 can be about 15/32 inch=½*(15/16) inch. Also in the example, the beveled or fourth surface 62 is defined by an imaginary triangle having a first side 72, a second side 74 and a hypotenuse (corresponding to the fourth surface 62), where the first side 72 is coplanar with the third surface 60 and can have a length of about 15/32 inch. The second side 74 is coplanar with the face 64 and can have a length, L, in the range of about 1/16 L ½ inch. An example of a more preferred length L of the second side 74 is 1/16 inch.

The panels 50 can optionally be wrapped in a fabric (not shown) (according to known technology) and/or the circumferential edge configurations can be hardened (according to known technology).

Figure 6:
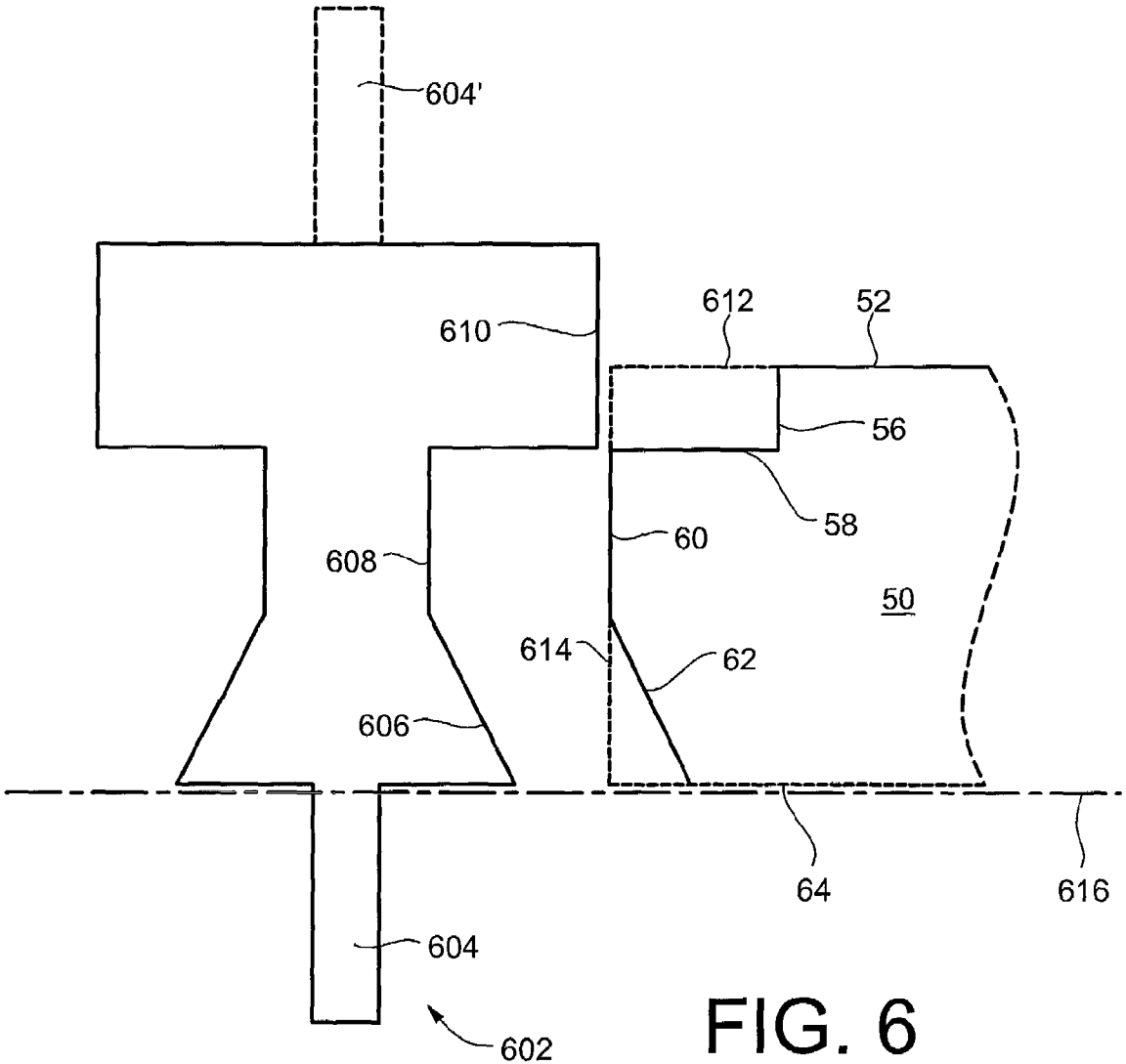
FIG. 6 is a cross-sectional view of an embodiment according to the invention showing a shaper/router bit used to form the edge configuration of a panel embodiment according to the invention.

FIG. 6 is a cross-sectional view of an embodiment according to the invention showing a shaper/router bit used to form the four surfaces 56, 58, 60 and 62 of the circumferential edge of a panel 50 according to an embodiment of the invention. In FIG. 6, the bit 602 is illustrated as a shaper bit extending up through a table or surface 616 of the shaper device. The panel 50 lies upon the surface 616 and is moved horizontally to engage the cutting surfaces 606, 608 and 610 of the shaper bit 602. The shank 604 of the bit 602 extends beneath the table surface 616 of the shaper device. Alternatively, the shank 604 could be located on the other end of the bit 602 (as depicted by phantom shank 604') to accommodate an overhead router. The silhouettes 612 and 614 of the material removed by the bit 602 are depicted in phantom lines. The optimal dimensions for the bit 602 (and complimentarily the circumferential edge of the panel 50) will vary depending upon the circumstances of the system of which the panel 50 is a part.

Figure 7A:
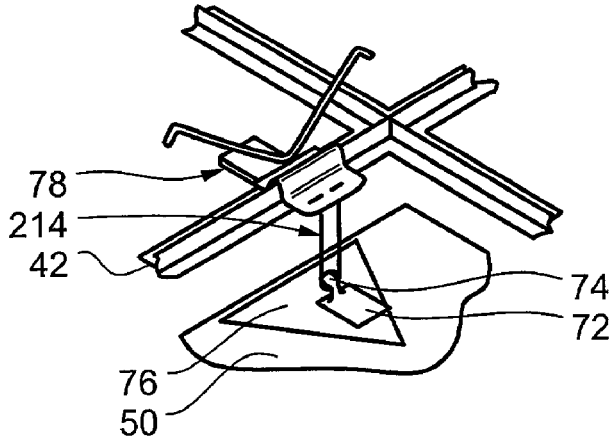
FIGS. 7A and 7B are three-quarter perspective views of a torsional spring arrangement for a ceiling panel according to an embodiment of the invention.
Figure 7B:
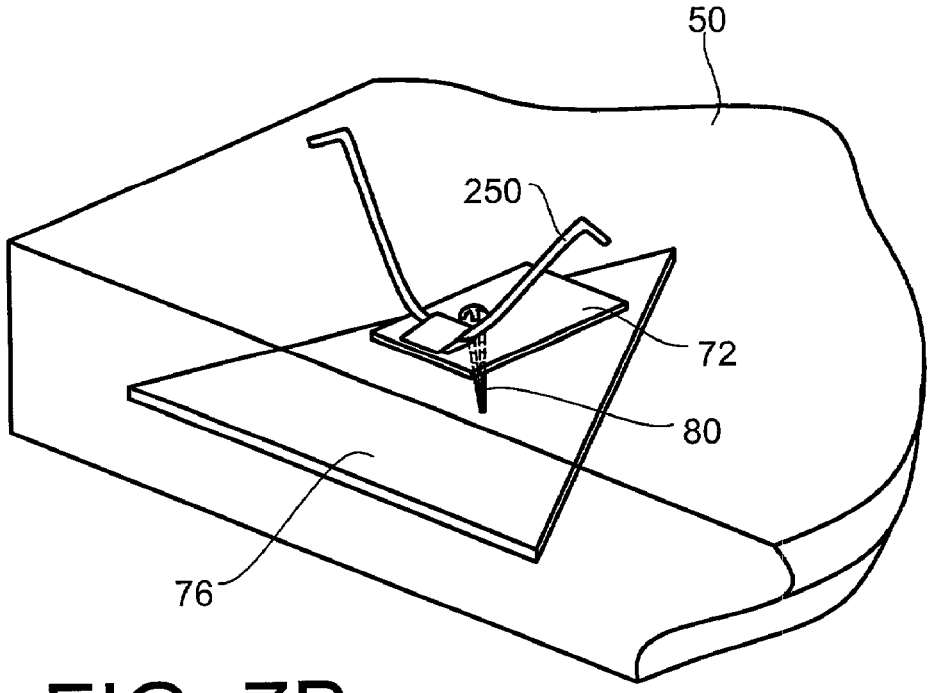

An advantage of the system 50 of FIG. 5 according to the invention is that it is unnecessary to provide a metal frame around each of the panels 50 in order to achieve a uniform machined distance of between the ceiling face 64 and the foot portions 44 of the T-bars 42. FIGS. 7A and 7B are three-quarter perspective views of preferred torsional spring arrangements that eliminate the need for the panel 50 to have a metal frame. The torsional spring arrangement of FIGS. 7A and 7B is known and is available from the CONWED DESIGN SCAPE Co. as a part of the RESPOND ACCESS CEILING brand of suspended ceiling.

In FIG. 7A, a support grid is formed of well-known T-bars 42. Similarly, well-known butterfly clips 78 are attached to the T-bars 42. A clip 72 having a hook 74 is attached to the back surface of a panel 50. A wedge 76 is inserted into the peripheral region of the panel 50 between the panel's laminae. The wedge 76 is preferably triangular in shape (although a variety of other shapes would also work, such as semi-circular trapezoidal, etc.). The wedge 76 is also formed of material that is relatively rigid and that can accommodate a releasable fastener, e.g., a self-tapping screw, 80 that connects the clip 72 to the wedge 76.

The second embodiment will now be discussed. As mentioned, the second embodiment provides a reinforced panel that is especially suitable for large-panel panel suspended ceiling systems. Typical ceiling panels are two feet by two feet and typically do not need to be reinforced, e.g., with a rib. The rib-reinforced panel according to the second embodiment of the invention can be used for larger panels, e.g., four feet by eight feet (a standard construction dimension). A preferred rib of the second embodiment is the well-known T-bar. Other types of ribs can be used, e.g., light gauge metal having an L-shaped cross-section. In the case where a T-bar is used as the reinforcement rib, a reinforced dimension of the panel can be about as large as the unsupported distance that the T-bar can span when used in a ceiling grid.

The preferred panels for the suspended ceiling system according to the invention are fiberglass panels such as those made available by the CONWED DESIGNSCAPE Co. as part of the RESPOND ACCESS CEILING brand of suspended ceiling system. Such panels have fiberglass laminae (not shown). According to the second embodiment, the reinforcement rib is added to a raw fiberglass panel, i.e., it is inserted as a post-manufacture step (after manufacture of the new fiberglass panel but before finishing steps such as edge hardening and/or fabric wrapping).

Figure 8A:
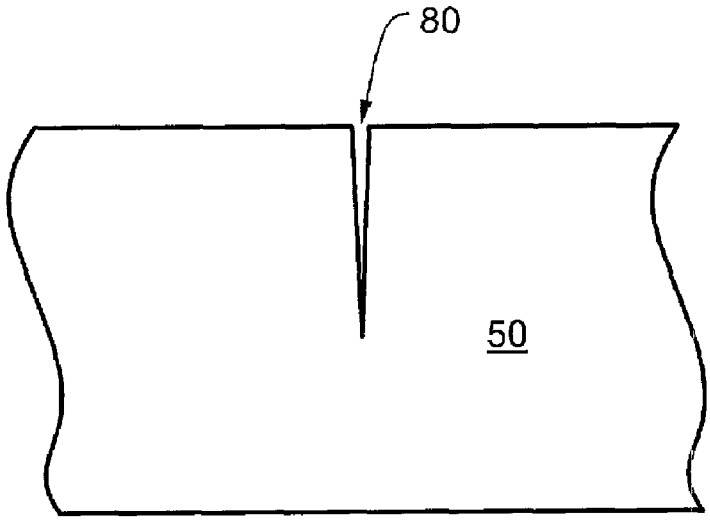
FIG. 8A is a cross-sectional view of a ceiling panel according to an embodiment of the invention that is being prepared for insertion of a reinforcement rib.
Figure 8B:
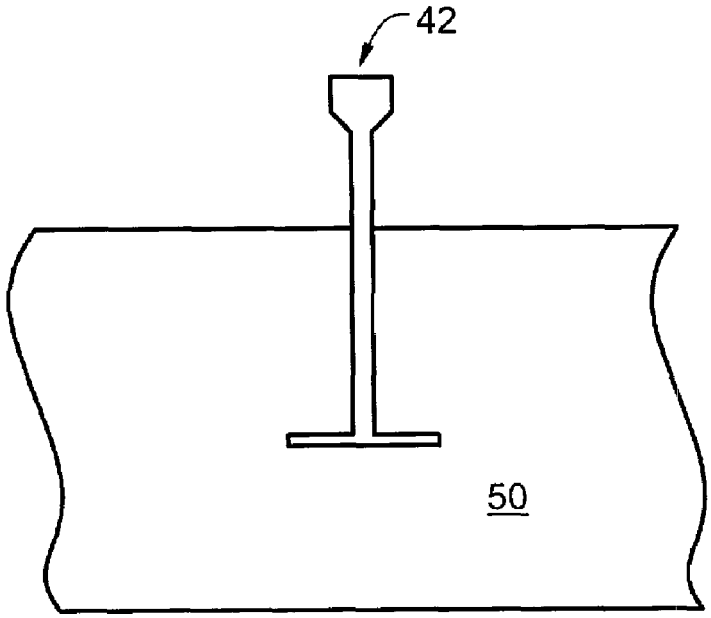
FIG. 8B is a cross-sectional view of a ceiling panel with an inserted reinforcement rib according to an embodiment of the invention.

The post-production insertion is depicted in FIGS. 8A and 8B. FIG. 8A is a cross-sectional view of a ceiling panel 50 according to an embodiment of the invention that is being prepared for insertion of a reinforcement rib.

In FIG. 8A, a slit 80 is cut into a panel 50, preferably across the grain of the laminae (again, not depicted). The slit is substantially perpendicular to the upper surface of the panel 50 and extends down approximately one-half the thickness of the panel 50. The depth of the split will vary according to the desired depth at which the reinforcement rib is to be positioned. An example depth is one-half of the panel's thickness as measured from the back to the face. FIG. 8*b* is a cross-sectional view that depicts a T-bar 42 that has been inserted into the slit 80 of panel 50. Alternatively, the leading edge (see 908, FIG. 9) of the T-bar 42 can be fashioned to be sharp so as to cut its own slot upon insertion.

Figure 11:
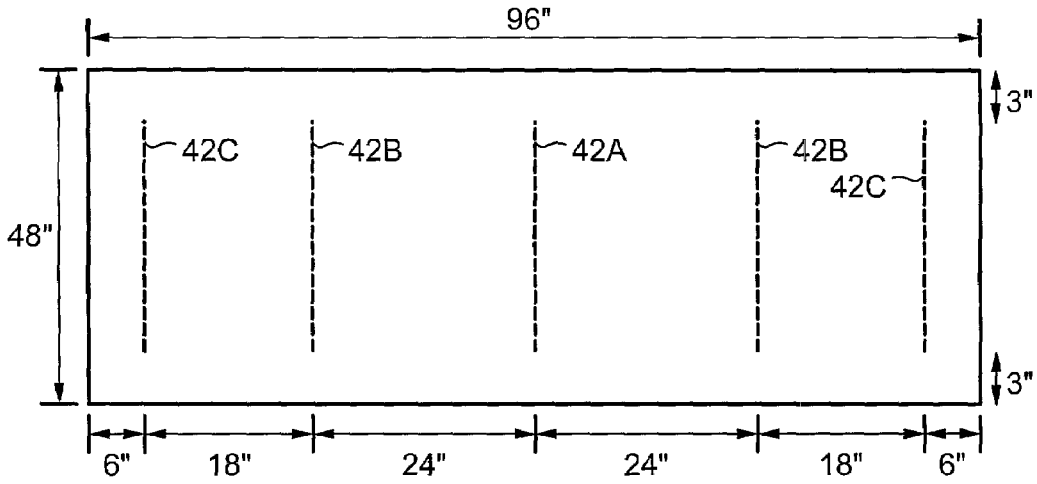
FIG. 11 is a plan view of an example distribution of reinforcement ribs in a ceiling panel according to an embodiment of the invention.

FIG. 11 is a plan view of an example distribution of reinforcement ribs in a ceiling panel according to an embodiment of the invention. The example panel is four feet by eight feet (a standard construction size). One of the T-bars 42A is located across the middle of the panel, i.e., 48 inches from the end. Second and third T-bars 42B are located at the ¼ and ¾ length positions, i.e., 24 inches from the center T-bar 42A. And fifth and sixth T-bars 42C are located 6 inches from the end of the panel. Each of the T-bars 42A, 42B and 42C is approximately 42 inches in length and centered so that there is three inches of the panel that extends beyond each end of the T-bar. Other distributions of reinforcement ribs are contemplated. Particular distributions will depend upon the circumstances of the system in which the ceiling panel having reinforcement ribs is a part.

Figure 9:
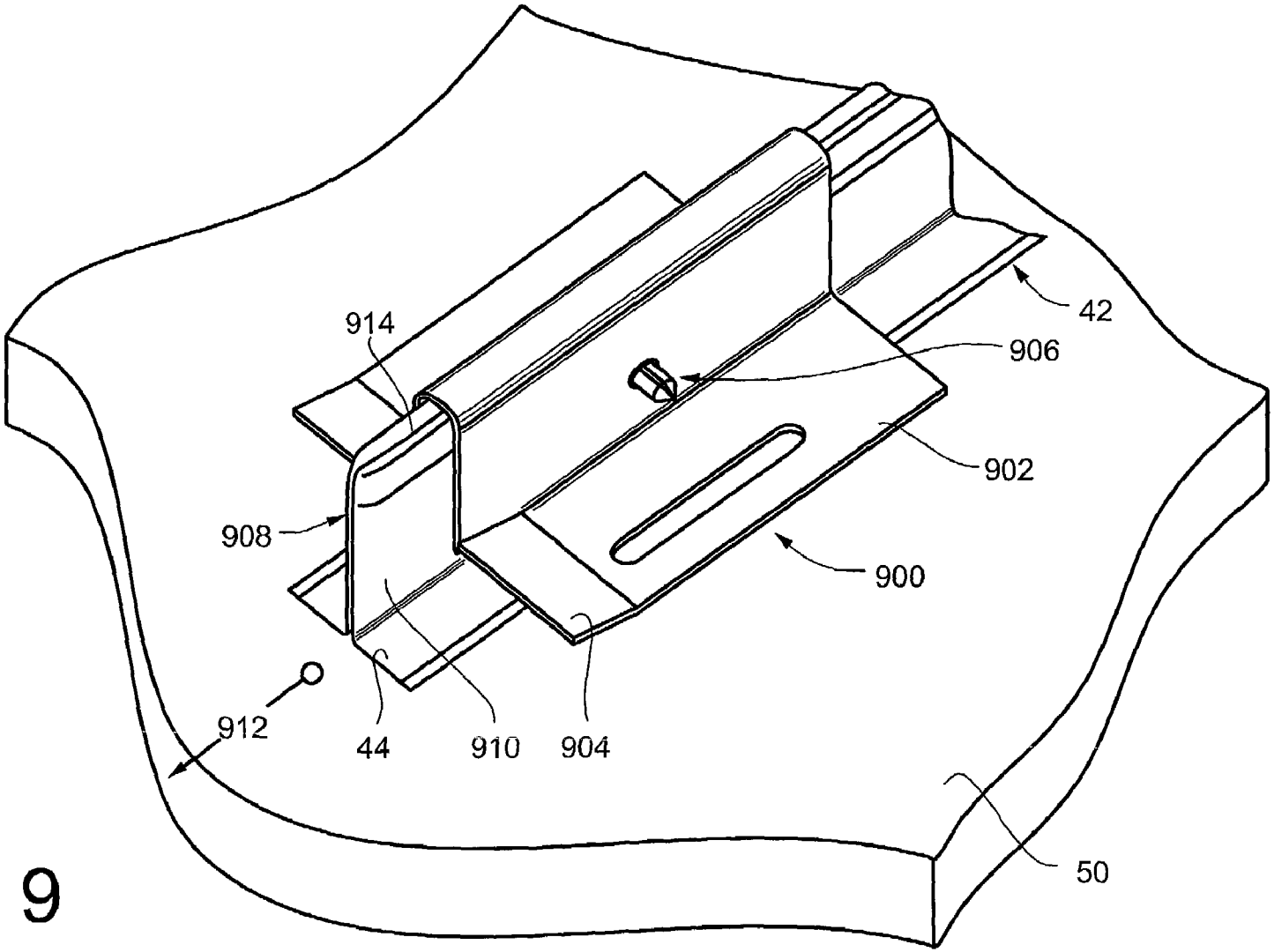
FIG. 9 is a three-quarter perspective view of an insertion jig according to an embodiment of the invention.

FIG. 9 is a three-quarter perspective view of an insertion jig according to an embodiment of the invention. A T-bar 42 is shown fitted with an insertion jig 900. Use of the jig 900 is not necessary but is very useful for ensuring that the foot portion 44 of the T-bar 42 is inserted at a uniform depth.

In FIG. 9, the T-bar 42 is shown resting on the back surface of a ceiling panel 50. The insertion jig/bracket 900 is similar in appearance to a butterfly bracket 78. The insertion jig 900 includes a depth control flange 902 that is positioned a predetermined distance above the foot portion 44 of the T-bar 42. A guide flange 904 is formed by an upwardly bent portion of the depth-control flange 902. The insertion jig 900 is connected to the T-bar 42 via a releasable fastener 906, e.g., a self-tapping screw.

Inspection of the leading end of the T-bar 42 (near which is attached the insertion jig 900) reveals that the foot portion 44 does not extend in the insertion direction 912 beyond the web 910 of the T-bar 42. Also, the bead portion 914 of the t-bar 42 has been pinched (908) at the leading end to streamline the leading end for movement through the panel 50.

Figure 10A:
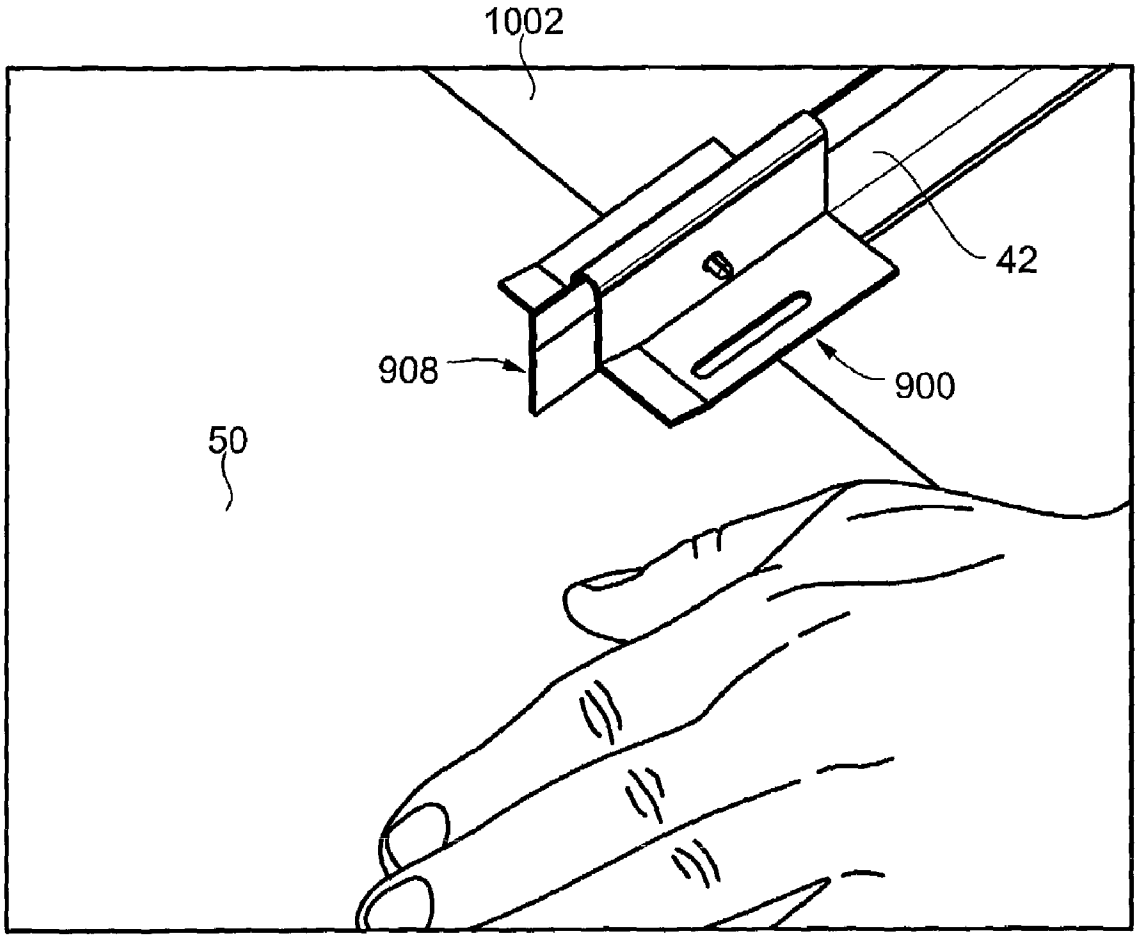
FIGS. 10A, 10B and 10C are three-quarter perspective views of the insertion jig according to an embodiment of the invention being used to insert a reinforcement rib according to an embodiment of the invention.
Figure 10B:
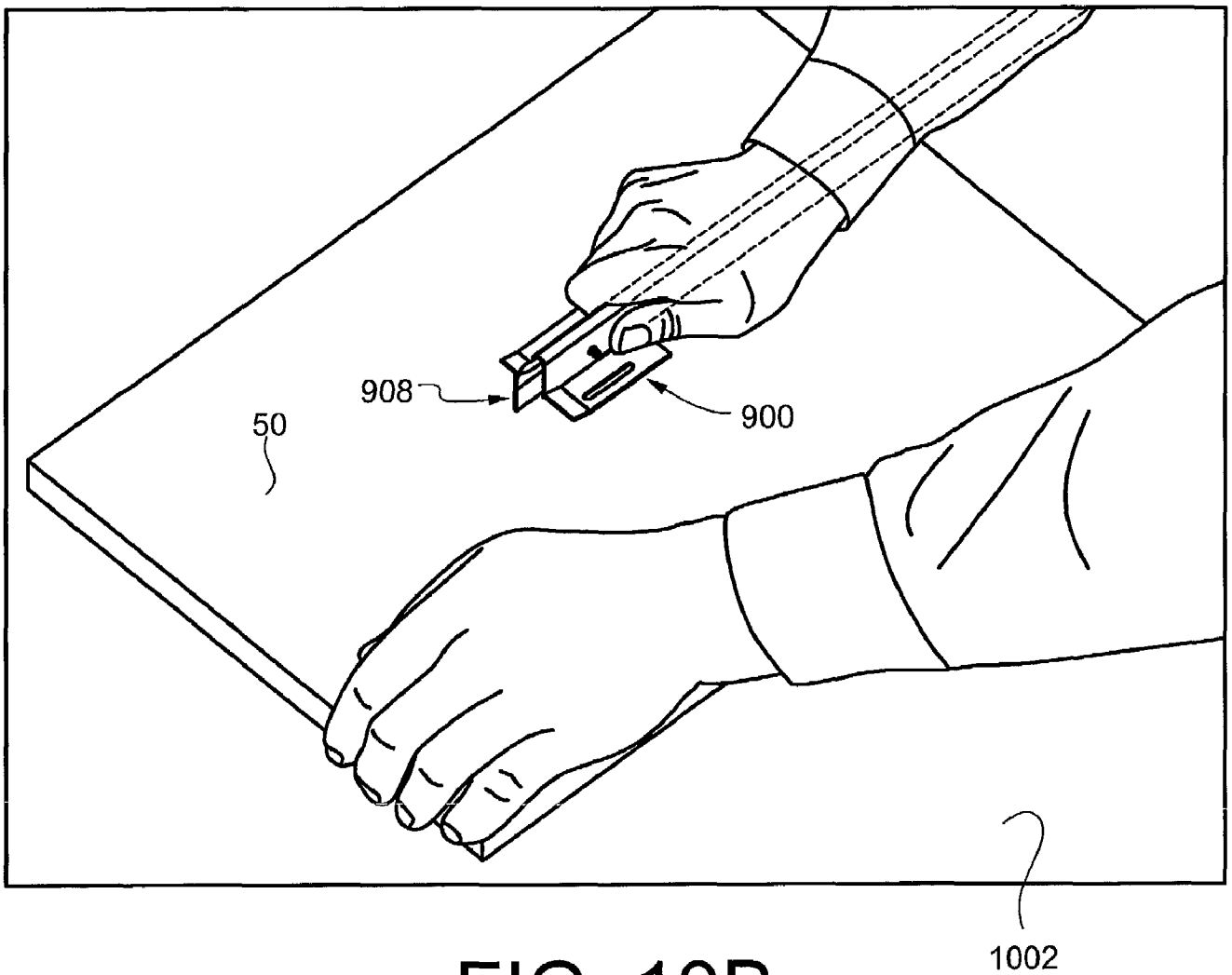
Figure 10C:
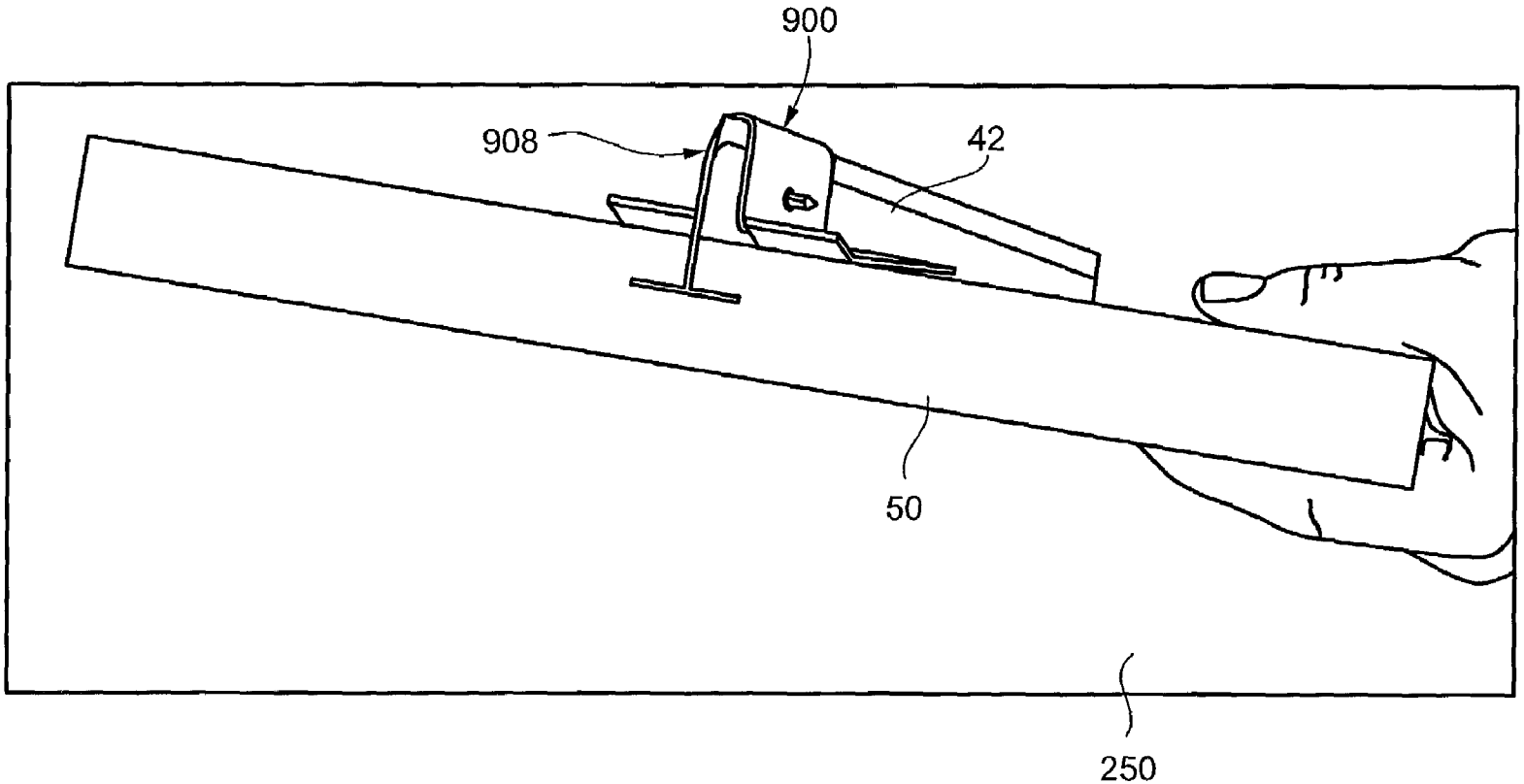

FIGS. 10A, 10B and 10C are three-quarter perspective views of the insertion jig according to an embodiment of the invention being used to insert a reinforcement rib according to an embodiment of the invention.

In FIG. 10*a*, the T-bar 42 fitted with the insertion jig 900 has just been inserted into the edge of a panel 50. The foot portion 44 of the T-bar 42 is obscured because the panel 50 is located between the foot portion 44 and the depth-control flange 902. It is noted that the panel 50 is lying upon a substrate (e.g., carpet) 1002. In FIG. 10B, the T-bar 42 fitted with the insertion jig 900 has been inserted approximately halfway through the panel 50. In FIG. 10C, the pinched leading end 908 (of the T-bar 42 fitted with the insertion jig 900) has been inserted all the way across the panel and has just emerged from the circumferential side edge.

In practice, the T-bar 42 will be inserted via the insertion jig 900 so as to be centrally located within the panel, i.e., so as to maintain a peripheral portion of the panel that extends beyond the T-bar 42, as in FIG. 11.

Figure 12A:
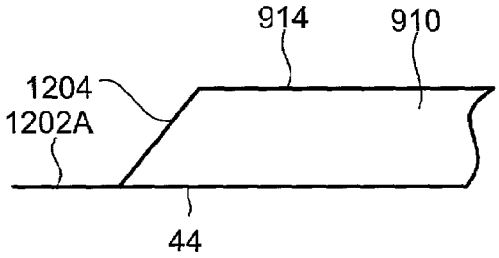
FIG. 12A is a side view of an embodiment of a reinforcement rib according to the invention.

FIG. 12A is a side view of an embodiment of a reinforcement rib according to the invention. FIG. 12A depicts a variation in the configuration of the leading end of the T-bar. In FIG. 12A, a portion 1202A of the foot portion 44A extends beyond the web 910. As with the T-bar 42 depicted in FIG. 9, a plan view (not shown) of the projecting flange 1202A would appear rectangular. Also, the alternative embodiment of FIG. 12A includes a tapered web portion 1204.

Figure 12B:
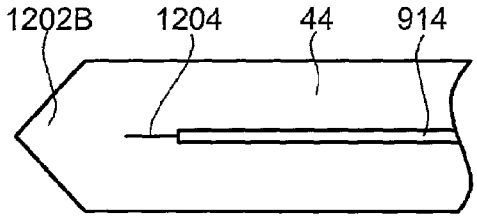
FIGS. 12B and 12C are alternative embodiments of a reinforcement rib according to the invention.
Figure 12C:
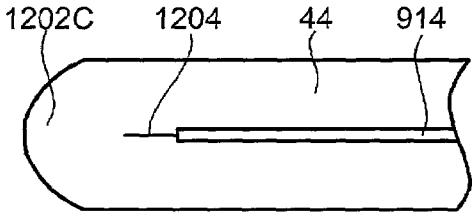

FIGS. 12B and 12C are alternative embodiments of a reinforcement rib according to the invention. The projecting flange 1202B is triangular shaped while the projecting flange 1202C is semi-circular. Other shapes of the projecting flange 1202 can be used.

It should be recognized that a ceiling panel can be made which has the circumferential ceiling edge of the first embodiment of the invention and/or the reinforcement rib of the second embodiment of the invention.

The invention may be embodied in other forms without departing from its spirit and essential characteristics. The described embodiments are to be considered only non-limiting examples of the invention. The scope of the invention is to be measured by the appended claims. All changes which come within the meaning and equivalency of the claims are to be embraced.

The invention claimed is:

1. A surface panel having a major dimension, a minor dimension and a thickness dimension, a side edge of said panel corresponding to said thickness dimension, a face surface of said panel facing toward a room and being substantially coplanar with a plane defined by said major and minor dimensions, a back surface of said panel being opposite of said face surface, wherein each side edge is multifaceted and includes:

a first planar surface intersecting said back surface;

a second surface intersecting said first surface and substantially parallel to said face surface;

a third surface intersecting said second surface and substantially orthogonal to said face surface; and a fourth surface intersecting, and being beveled relative to, said third surface; and wherein, in a circumstance in which two of the surface panels are located adjacent each other such that respective said third surfaces are substantially abutting, the fourth surface is arranged so as to also represent a surface of a reveal formed between the two adjacent panels.

2. The surface panel of claim 1, wherein the fourth surface intersects said face surface.

3. The surface panel of claim 1, wherein said first surface is substantially orthogonal to said back surface.

4. The surface panel of claim 1, wherein said surface panel is a ceiling panel for a suspended ceiling.

5. The surface panel of claim 1, wherein said surface panel is a wall panel for an acoustical wall system.

6. The surface panel of claim 1, wherein a height of said third surface is about half of the distance between said second surface and said face surface.

7. The surface panel of claim 6, wherein said distance between said second surface and said face surface is $15/16$ inch, a length of said third surface is about $15/32$ inch and wherein the bevel of said fourth surface is defined by an imaginary triangle having a first side, a second side and a hypotenuse, said first side being coplanar with said third surface and having a length of about $15/32$ inch, said second side having a length, L, in the range of about $1/16$ inch$\leqq$L$\leqq$about $1/2$ inch.

8. The surface panel of claim 7, wherein L is about $1/16$ inch.

9. The surface panel of claim 1, wherein the fourth surface is a continuous surface.

10. The surface panel of claim 1, wherein the first, second, third and fourth surfaces together present a generally convex conformation.

11. The surface panel of claim 1, wherein the fourth surface is substantially planar.

12. A surface paneling system including a plurality of surface panels each having a major dimension, a minor dimension and a thickness dimension, a side edge of said panel corresponding to said thickness dimension, a face surface of said panel facing toward a room and being substantially coplanar with a plane defined by said major and minor dimensions, a back surface of said panel being opposite of said face surface, wherein each side edge is multifaceted and includes:

a first planar surface intersecting said back surface;

a second surface intersecting said first surface and substantially parallel to said face surface;

a third surface intersecting said second surface and substantially orthogonal to said face surface; and a fourth surface intersecting, and being beveled relative to, said third surface;

wherein said plurality of panels are arranged in an array in which respective third surfaces abut against each other without intervening framing material; and wherein, at any two such abutting panels, a triangularly grooved reveal is formed by respective said fourth surfaces due to the beveling such that said array of panels' exhibits a grid of said triangularly grooved reveal.

13. The system of claim 12, wherein said surface paneling system is a suspended ceiling system.

14. The system of claim 13, wherein said surface paneling system is an acoustical wall system.

* * * * *